US006027116A

United States Patent [19]

Patermann

[11] Patent Number: 6,027,116

[45] Date of Patent: Feb. 22, 2000

[54] DIDACTIC SKILL-DEVELOPING, MULTI-COMBINABLE MINIATURE TOY OR ORNAMENT

[75] Inventor: Francisco Josa Patermann, Pals, Spain

[73] Assignee: National Project S.A., Luxembourg

[21] Appl. No.: 09/088,732

[22] Filed: Jun. 2, 1998

[30] Foreign Application Priority Data

Feb. 6, 1997 [ES] Spain ..... 9701201

[51] Int. Cl.[7] ..... A63F 9/08

[52] U.S. Cl. ..... 273/153 S

[58] Field of Search ..... 273/153 R, 153 S, 273/156

[56] References Cited

U.S. PATENT DOCUMENTS

| | | | |
|---|---|---|---|
| 5,271,688 | 12/1993 | Chang | 273/153 S |
| 5,358,247 | 10/1994 | Meffert | 273/153 S |
| 5,566,941 | 10/1996 | Destics | 273/153 S |
| 5,722,657 | 3/1998 | Cabrera | 273/153 S |
| 5,779,238 | 7/1998 | Josa-Patermann | 273/153 S |

FOREIGN PATENT DOCUMENTS

| | | |
|---|---|---|
| 607437 | 3/1994 | European Pat. Off. . |
| 712649 | 5/1996 | European Pat. Off. . |

*Primary Examiner*—Steven Wong
*Attorney, Agent, or Firm*—Dennsion, Meserole, Scheiner & Schultz

[57] ABSTRACT

DIDACTIC SKILL-DEVELOPING, MULTI-COMBINABLE MINIATURE TOY OR ORNAMENT, in which the a sphere (1) is made up of two hemispheres (10–11) coupled by a grooving and tonguing assembly, with a centering element (16–16A), joined by concealed fittings (6–6A) and provided with six housings (12) for each part of a T-shaped guide (4) and three retractile locking devices (17, 17A, 17B) incorporated into the immobilized pivotal octant (2) where its seven parts or movable octants (5) fit, as well as an octant-pivot (2A), adapted specially and differently, to be fitted to independent objects, instruments or such like, and also a covering or enveloping octant which is also specially adapted for this purpose. It applies to a toy or ornaments of small size.

21 Claims, 16 Drawing Sheets

FIG. 1-A
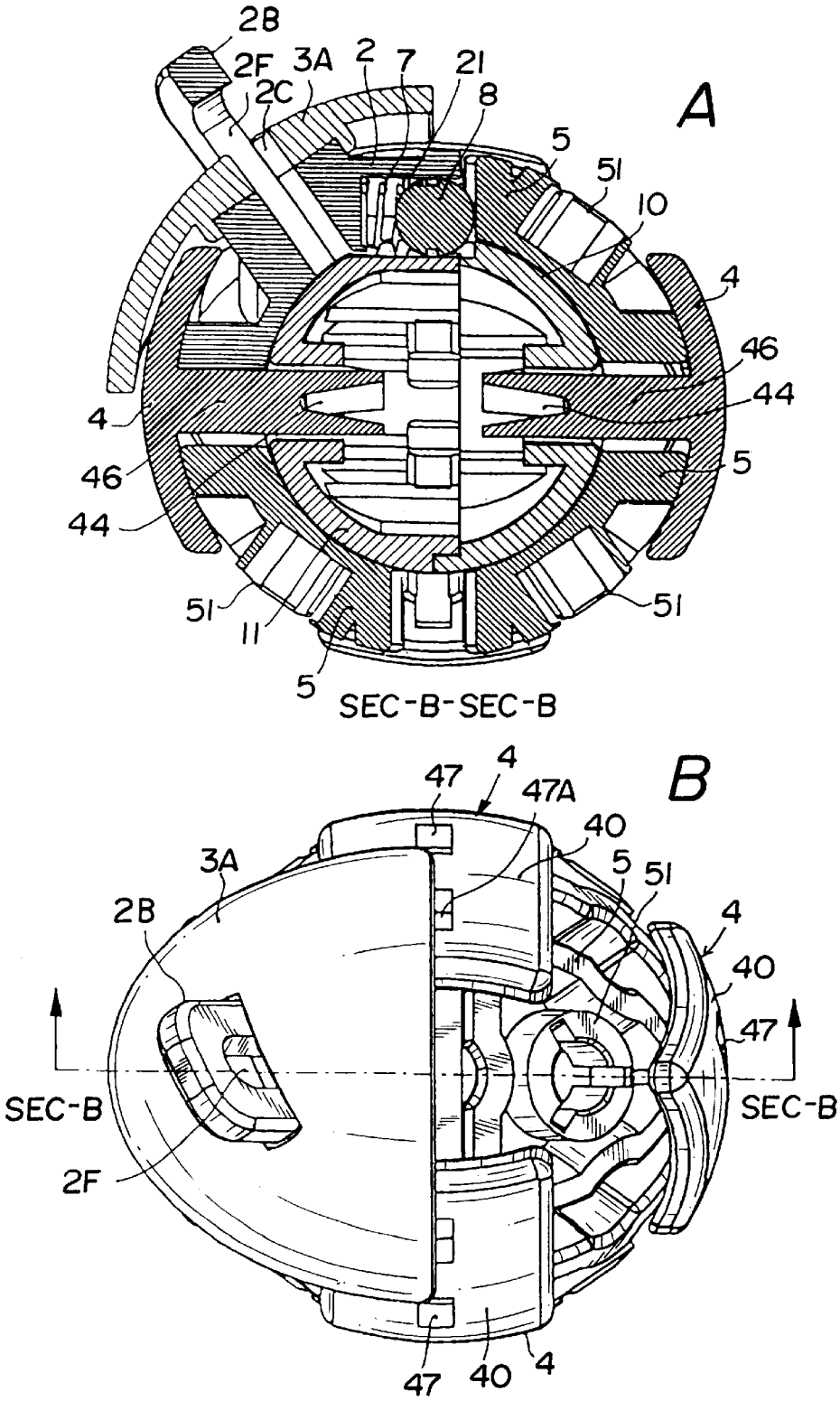

FIG. 1-B
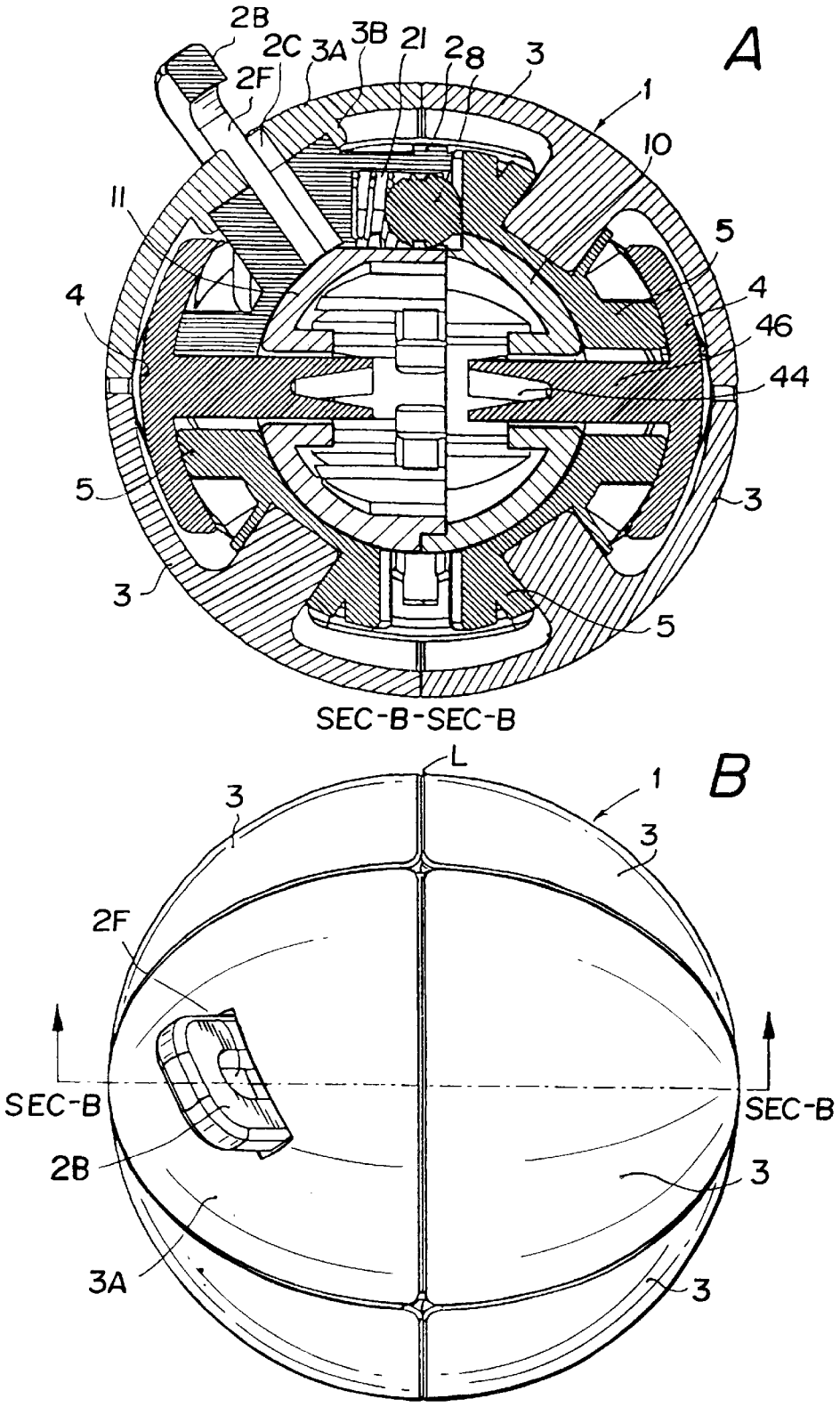

DIDACTIC SKILL-DEVELOPING, MULTI-COMBINABLE MINIATURE TOY OR ORNAMENT

SPECIFICATION

The invention refers, as the title indicates, to a DIDACTIC SKILL-DEVELOPING, MULTI-COMBINABLE MINIATURE TOY OR ORNAMENT, based on a regular dihedral body, specifically a spherical block sub-divided into a regular and exact number of fractions that may be moved by the user's hands around the nucleus of the said body, the movements being made in the direction of its coordinate axes and independently of the planes in which the said axes subdivide the sphere or specific dihedral body.

It is the object of the invention mainly to harmonize the interior structure of the toy, keeping the number of external common parts invariable, with the appropriate expressions or manifestations for the representation of the figure, image or character that one wishes to display. That is, all the internal parts of the assembly are invariable as regards their function, so that only the covering parts that show the visible side of the toy are to be designed and moulded with one of the parts of the toy that is a "puzzle or brain teaser" which the assembly configures in whatever version of the object, character, animal or thing that may be reproduced.

Therefore, these covering parts which show the visible side of the toy will necessarily have an exact basic portion, proportional to the spherical or exahedral volume of the assembly, being ⅛ of the latter with the same basic and obligatory design and, also necessarily, with analogous fixing or anchoring means in all these parts.

In any case, the invention relates mainly to the background included in the State of the Art of the inventor himself.

STATE OF THE ART

The functional and operational basis of this invention, as well as the structural conception of the same, is based on the inventor's patents:

| | |
|---|---|
| EP No. 94500184 for: | "A MULTICOMBINABLE, DIDACTIC, SKILL-DEVELOPING RECREATIONAL DEVICE" |
| Filed on Nov. 18, 1994. | |

Filed on Nov. 18, 1994.

PCT/ES/92/00066 subsequently converted into EP 92918614.6 with international publication number WO 94/04235, dated Mar. 3, 1994.

The invention stems from a single conception, an internal spherical nucleus with six bracing or fixing points orthogonally perpendicular to each other.

A set of six parts identical to each other which, braced to the six points mentioned above, serve as a guide to the movable and supporting parts.

A set of eight support parts of exact dimensions, seven of which are displaceable or equally movable in relation to each other, and one of which is fixed and unequal serving as a pivot for the orbital movement of the others.

And eight covering parts, which form an external part of the reproduced object, of exact dimensions, and which are provided with anchoring means in the supporting parts. One is to be fixed and the other seven movable or displaceable in unison with these, which also have a portion that is of exact dimensions and proportional to the body.

The functional conception is, substantially, the same.

The operation of the portions, being proportional to the form and volume of the nucleus and of the assembly, will be basically and fundamentally of the same forms and proportions.

The mechanisms, therefore, correspond to a single functional version.

In any case, and in accordance with the version of this invention, the structural aspects, development of the parts, design and particular details of the parts are original, according to the interpretation of their inventive step.

INVENTIVE STEP

An idea of the invention is to incorporate a spherical nucleus with a hollow structure, divided into two parts which fit together by means of a tonguing and grooving and which have centering means. The two parts join together by means of fittings, the heads of which are concealed or hidden in the internal part of the structure, making up the six housings—orthogonally and symmetrically distributed—for the guide parts; access means for the said fittings and means for localizing the octant which acts as a pivot.

In another idea of the invention, a guide part is incorporated which, having the same general structural form, has direct anchoring and fixing means which, while determining the positional fixing of the part, do not prevent a certain vertical mobility in the latter so as not to impede the movement of the movable and supporting parts.

Another idea of the invention is that the said seven movable parts mentioned in the foregoing embodiment are, by reason of the proportional imperative, the equivalent of an octant of a sphere, made up, therefore, of a triangular-spherical section with dimensions of the necessary measurements to circulate over the spherical nucleus, except for the pins of the guide parts housed in the six above-mentioned housings. It is a part that is moulded on its upper plane so that the central member for bracing the covering parts does not protrude from the plane that defines the exterior side (convex), while its sides (or cathetuses) have means to fit into place relatively in the positions marked by the immobile or non-displaceable pivot part.

Another idea of the invention is that the said immobile pivot part has an analogous form to the foregoing ones with an identical proportion. It is also made up of a body that is moulded in its upper plane, but the central joining member for the covering part protrudes slightly from the plane that defines the exterior side (convex) of the latter. Also, inside it has symmetrical radial means which, in combination with others of the spherical nucleus, form the housings for three elastic (retractile) locking members.

In accordance with another idea of the invention, the said immobile part, in another embodiment, has complementary means on the central joining member to fit a keyring or any object, pendant, ornament or such like, which means that the covering part associated with the latter is to be configured in accordance with the characteristics of the said means.

With respect to the said particulars, we submit the detailed explanation of the features of the invention, which is made basically of non-toxic, ABS plastic materials, the fittings being made of non-corrosive, stainless steel, metallic materials.

DESCRIPTION OF THE INVENTION

Thus the spherical part or nucleus is a semi-hollow body divided into two parts which fit together by means of a tongue and groove system, and in which, coinciding with the edges of the housing and/or with the axis of simmetry, there is a small bayonet joint for centering both parts.

One of these parts comprises the structure with the female parts for fixing (thread, pressure or other means) the fittings which serve to join the two parts of the sphere, in which the opposite one has two diametrically opposed holes, with countersunk and oblique openings, through which the head of the fixing fitting passes, which is concealed beneath the sphere.

Also, the other hemispherical part—the one opposite to that which has the holes for the fittings—features on its outside, in a quadrant of the same, three concave undercuts, oblong and truncated at one end, which are distributed radially and equidistantly from each other. They form the seatings for the balls and—springs of the retractile locking devices incorporated in the part—immobile octant.

The six housings for the guide parts are recessed cavities with a square opening and bevelled edges which are delimited inside by four parallel walls which penetrate to at least half of the internal radius of the sphere.

The inner edges of these walls are the anchoring points for the guide parts.

The six cavities are equidistant and orthogonally distributed; four coincide with the joining line of the two parts of the sphere—half on each side—and the other two are at the poles of each part.

The first four cavities are delimited by four walls that are separated from each other. Three of these are contained in the hemisphere which has the clamping points, and the other in the opposite hemisphere; the second two are delimited by four joined walls or square tubular holes.

The guide parts fitted in the said six cavities have the known "T" form of the State of the Art. The head is square-shaped, curved parallel to the sphere and has double bevelled edges and rounded corners.

The said curved planes have, both inside and out, a degree of curvature that coincides respectively with the spherical plane described by the eight movable and fixed parts and the eight covering or enveloping parts.

The stanchion is a prismatic pin that is cut at the lower end by an angular aperture in the form of pincers, so that the tips have projections in the form of locking hooks.

The arrangement of the holes, their internal structure and the symmetry of the guide parts allows the fixing pin to be fitted without requiring a precise entry position.

As we have indicated in the Inventive Step, the seven movable parts of the size of the octant of a sphere are triangular-spherical parts, moulded on their convex exterior plane, that define a central cylinder which does not protrude beyond the surface plane and which has three vertical slots inside for bayonet fitting of the respective covering or enveloping parts.

The upper edges of the said part's sides are bevelled, the angle edges rounded and the sides chamfered and recessed towards the base. In the centre of each side, coinciding with the axis of its radius, it has vertical trochilus mouldings. These are mortises that serve for interlocking relatively and circumstantially, when the parts pass through the locking points of the immobile pivot part.

Finally, the octant or immobile pivot part has a form substantially the same as the foregoing and is, of course, of identical dimensions. The assembly means for the covering or enveloping parts are the same, albeit with a slight difference: they protrude slightly for coupling the respective covering part in a case of special embodiment.

The angle edges are moulded at right angles, the same as those that are known. It has inside, especially, arched passages that are radial and equidistant, closed inside and open outside. These are guides for housing the locking members. Three locking points made up of the known spring and ball parts. A spring and ball that are housed in the said passages and in the undercuts of the hemisphere that coincide with these.

The above-mentioned vertices of these parts that are moulded at right angles coincide and couple with the coincidental edges of the three adjacent pins of the T-shaped guide parts.

In a different version of the said part, the assembly means with the covering or enveloping part is adapted to constitute an anchoring member for a keyring or other fastening means, object, ornament or the like.

For this purpose, the respective covering part related with the foregoing version will also be different and specially adapted to be fitted in the said assembly means.

We present a broader idea of the essential characteristics of the invention below when reference is made to the sheets of drawings that accompany this specification in which, in a rather schematic way, and only by way of example, the preferred details of the invention are shown.

In the drawings:

FIG. 1 is an upper plan view of a hemisphere seen inside, as a whole.

FIG. 1A–A is a sectional view by the line B–B- of FIG. 1A–B.

FIG. 1A–B is a side elevation view at 900° to FIG. 1.

FIG. 1B–A is a sectional view by the line B–B- of FIG. 1B–B.

FIG. 1B–B is an plan view of FIG. 1, seen from the outside.

FIG. 2A is a perspective view of the set made up of the pivot part nucleus and the respective covering or enveloping part adapted to be joined to the independent object.

FIG. 2B is a plan view through the interior base of the pivot part.

FIG. 2C is an elevational view referring to FIG. 2A.

FIG. 2D is a sectional view by the line A—A of FIG. 2C.

FIGS. 2A–A, 2A–B, 2A–C and 2A–D are analogous to the foregoing views 2–A, B, C and D in a version that is not adapted to be joined to another independent object.

FIG. 3A is an exterior perspective view of the hemisphere provided with the adaptors for the locking devices and with its guide parts incorporated.

FIG. 3B is an interior view analogous to the foregoing.

FIG. 3A–A is an elevational view of the nucleus with its guides and an octant with the angular development of its movement.

FIG. 3A–B is a plan view at 90° to the foregoing.

FIGS. 4A show an exterior plan view of the hemisphere from FIG. 3.

FIG. 4B is an inside plan view of the foregoing hemisphere.

FIG. 4C is an inside plan view of the opposite hemisphere.

FIG. 4D is a perspective view of the two hemispheres in projected coupling and with their joining fittings.

FIG. 5A is a upper plan view of the T-shaped guide part.

FIG. 5B is a sectional view by the line C—C of the foregoing figure.

FIG. 5C is a lower plan view at 90° to FIG. 5B.

FIG. 5D is a side elevational view at 90° to FIG. 5A.

FIG. 5E is a perspective view of the part shown in the foregoing FIGS. 5.

FIG. 6A is a sectional view by the line D—D of FIG. 6B of a movable part.

FIG. 6B is a plan view through the exterior side of the said part.

FIG. 6C is an elevated view at 90° to figure B.

FIG. 6D is a plan view through the internal side at 90° to FIG. 6C.

FIG. 6E is a perspective view through the external side of the said part.

FIG. 7A is a sectional view by the line E—E of FIG. 7B of the pivot part.

FIG. 7B is a plan view of the external side of the said part.

FIG. 7C is an elevated view of at 90° to FIG. 7B.

FIG. 7D is a plan view through the internal side at 90° to FIG. 7C.

FIG. 7E is a perspective view of the part shown in FIG. 7 through its external side.

FIGS. 7A–A, 7A–B, 7A–C, 7A–D and 7A–E are analogous views to FIGS. 7A, 7B, 7C and 7E in a version adapted for incorporation to another independent object, keyring, ornament, instrument, utensil or such like.

FIG. 8 is an example in plan view, seen inside, of the head of a duck with the pivot part adapted for an anchoring member.

FIG. 9 is a perspective view of the heads of each duck and mouse, in accordance with the invention, adapted as keyrings.

FIG. 9A is a perspective view of a balloon, in accordance with the invention, adapted as a keyring.

FIGS. 10A, B, C are perspective views of each set of fittings, springs and balls of the joining means for the parts of the spheres and respective locking devices.

DESCRIPTION OF THE DRAWINGS

The drawings represent in detail the assemblies, parts and forms of the invention, its structural features and its design peculiarities.

An analysis of these facilitates a broad understanding of the invention's content.

Figure 1:
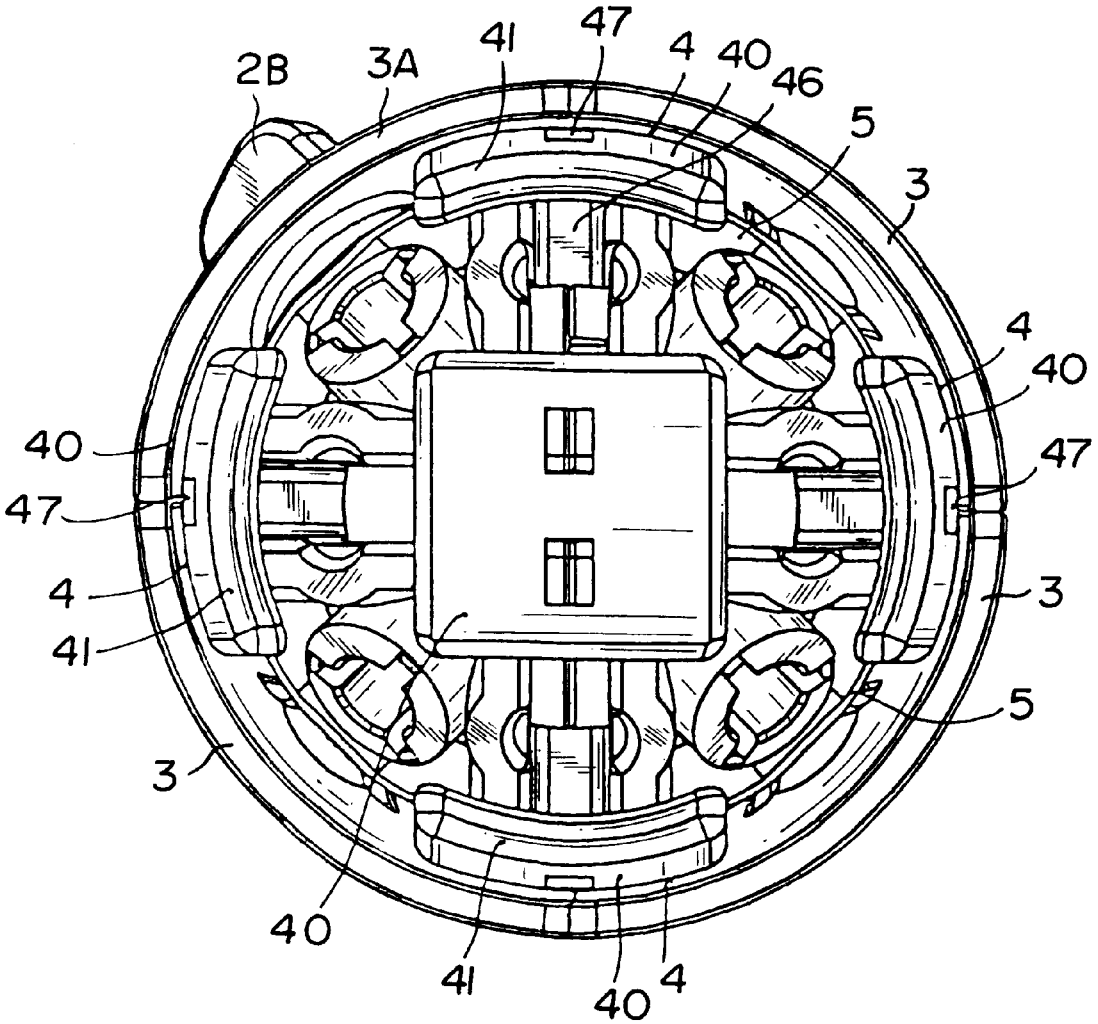
Figure 2:
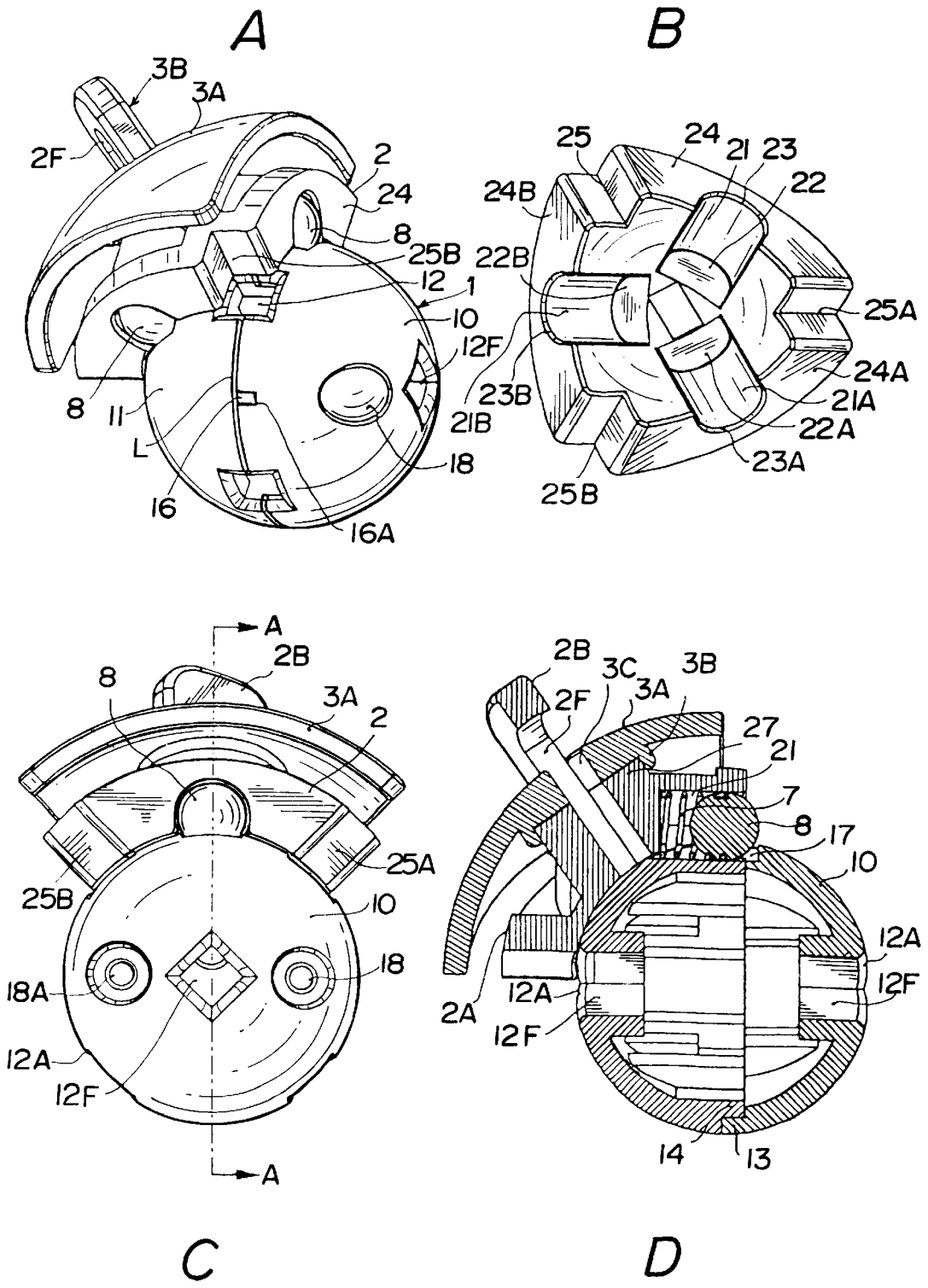
Figure 7:
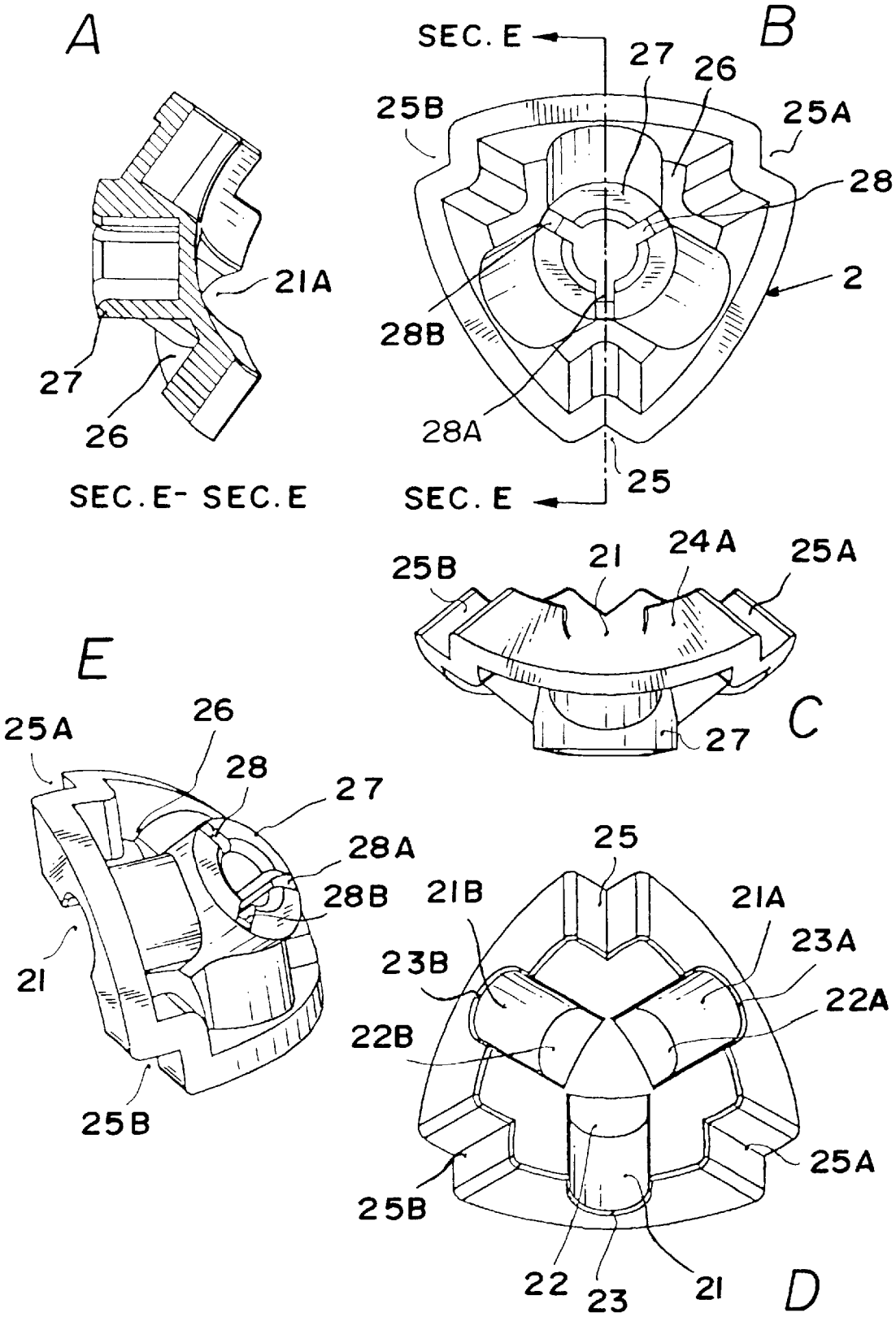
Figure 7A:
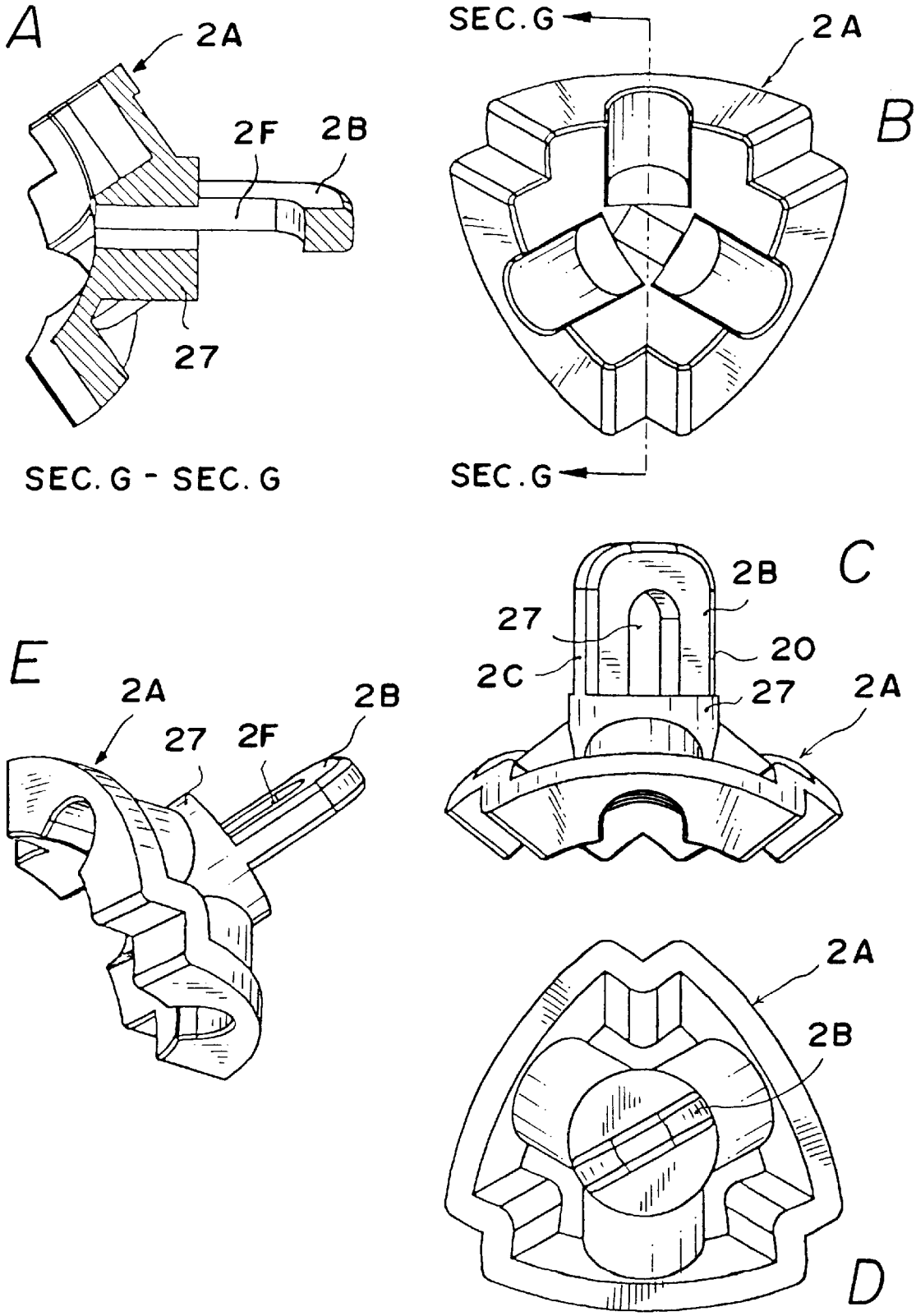

From the representations of FIG. 2 and successive figures up to FIG. 7A, we see representations of the semi-assemblies and breakdowns of the invention.

The sphere or nucleus of the assembly is indicated by (1) in a general way, (10) and (11) being the hemispherical parts that form it.

(2) indicates the non-movable pivot part, (2A) being the differently adapted version of the same, with its respective covering or enveloping parts (3) and (3A).

(4) indicates in a general way the T-shaped guide parts and (5) indicates the movable or displaceable parts that also serve to support their respective covering or enveloping parts (3).

The two hemispherical parts (10) and (11) which form the nucleus (1) are respectively coupled together by grooving and tonguing assembly (13) (14), with the fitting (16) (16A) serving as a centering element (FIGS. 2A–A and 2A–D).

The nucleus (1) has six cavities (12) distributed equidistantly and orthogonally on the spherical body; four are situated at 90° on the assembly line (L) and two on the poles of each hemisphere (10) (11). These cavities (12), designed for fitting the T-shaped guide parts (4), have an opening with bevelled edges (12A) and are formed inside in a different way. The four holes (12) of a line of intersection (L) through two parallel walls (12B–12C) and two parallel arms (12D–12E). The walls (12B–12C) and the arm (12D) are integrated into the hemisphere (11). The arm (12E) is integrated into the hemisphere (10). The housings (12) of the poles have a square-tubular shape (12F). They have a depth that is less than half of the internal radius of the sphere, a length calculated so that the part's anchoring member (4) may lock against the inner edges (12C) of the said walls (12B–12C), arms (12D–12E) and tubular hole (12F).

The assembly of the two hemispheres (10–11) makes the housings (12) fit together in this way.

The gridded formation of the housings (12) formed by both the combination of the walls (12B–12C) and arms (12D–12E) and the tubular body (12F) allows the guide parts (4) to fit into the said housings without requiring the latter to be precisely and necessarily orientated. They fit simply and easily.

Figure 3:
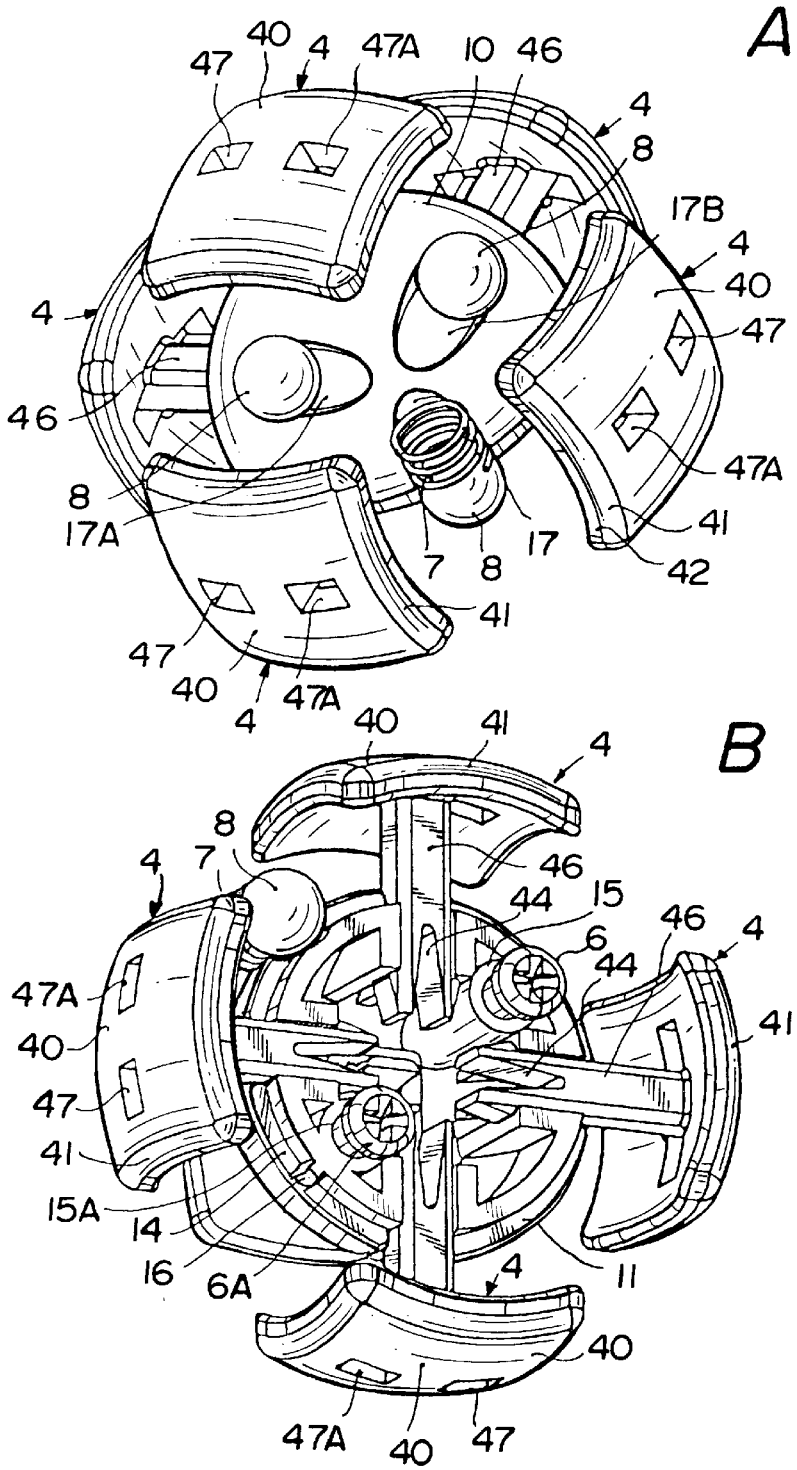
Figure 3A:
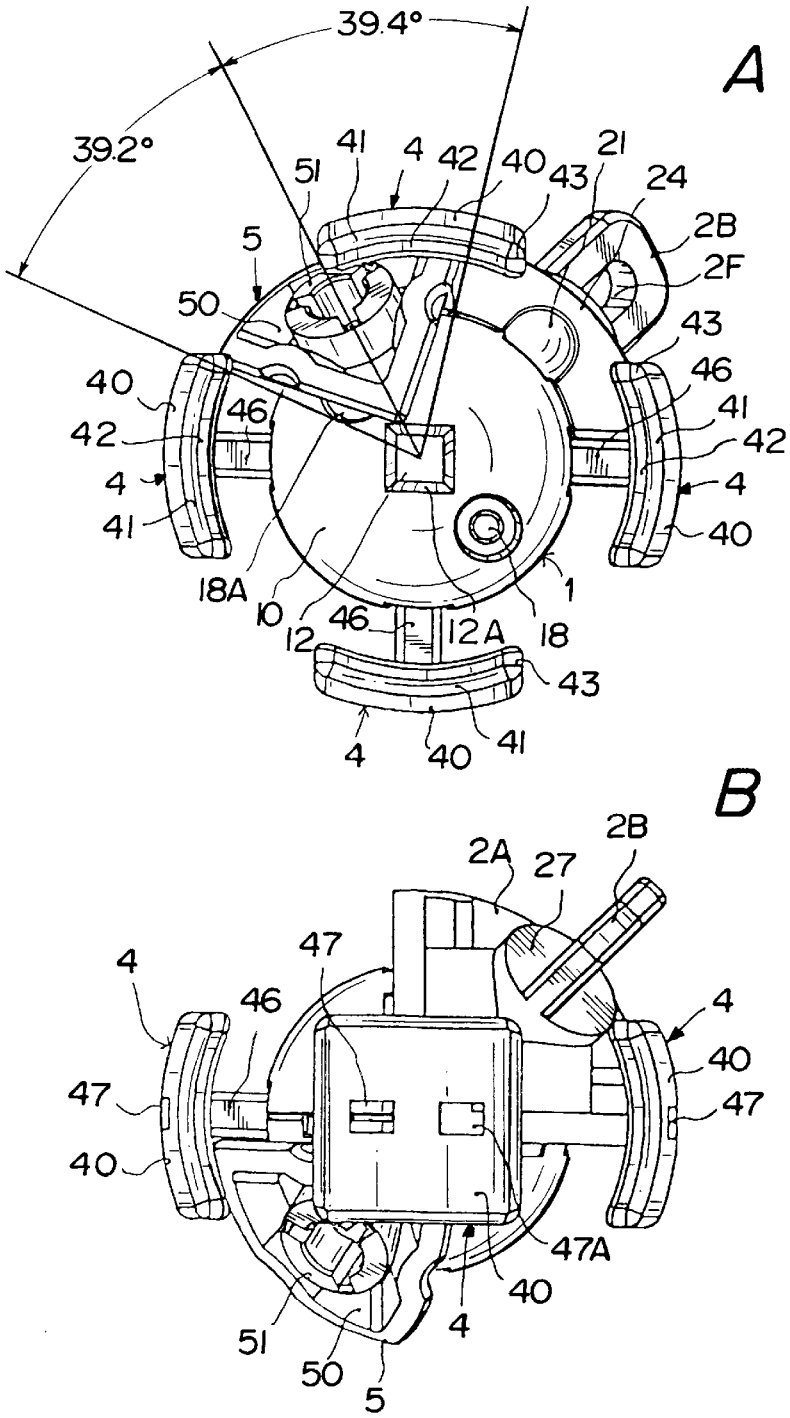
Figure 4:
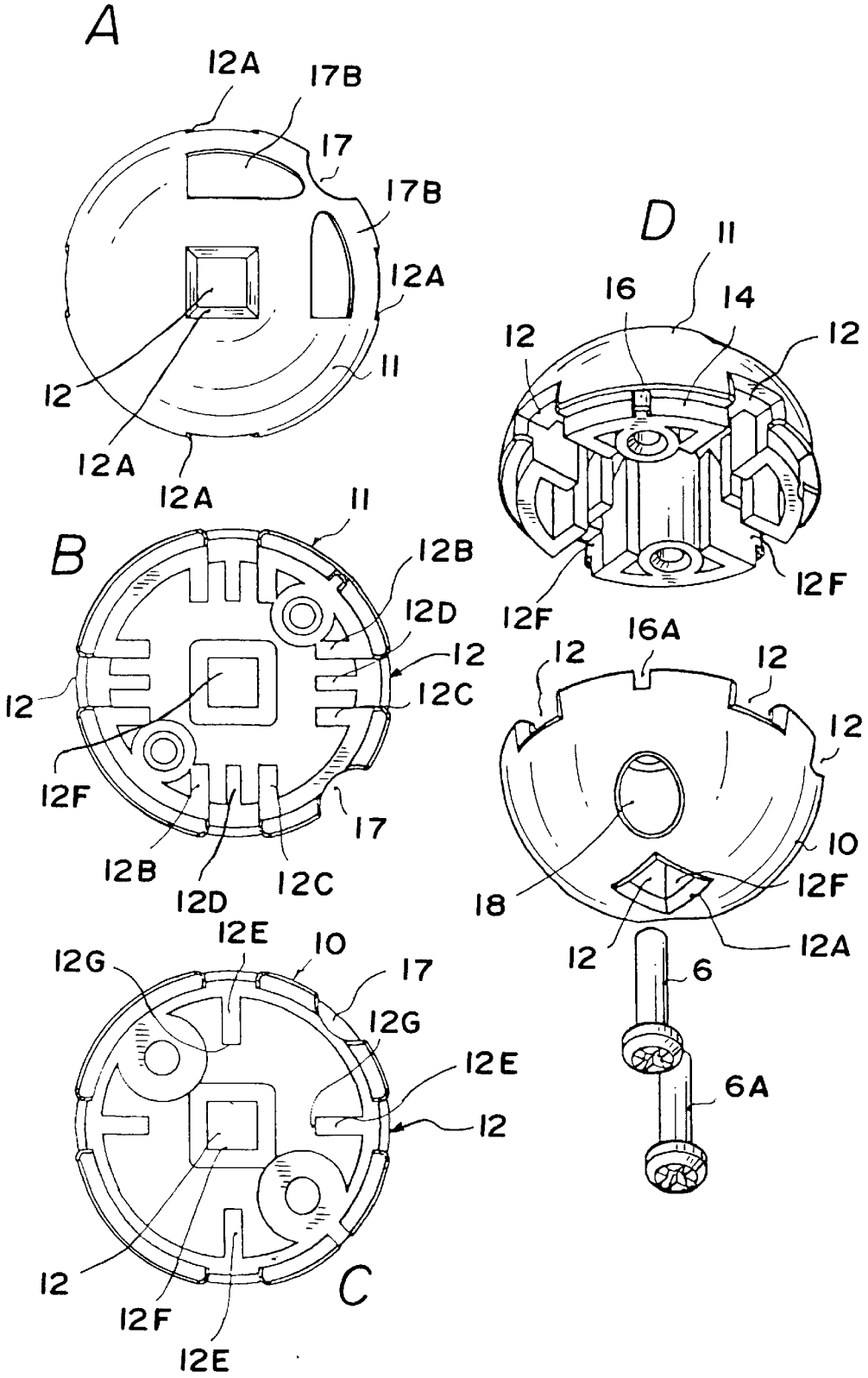
Figure 5:
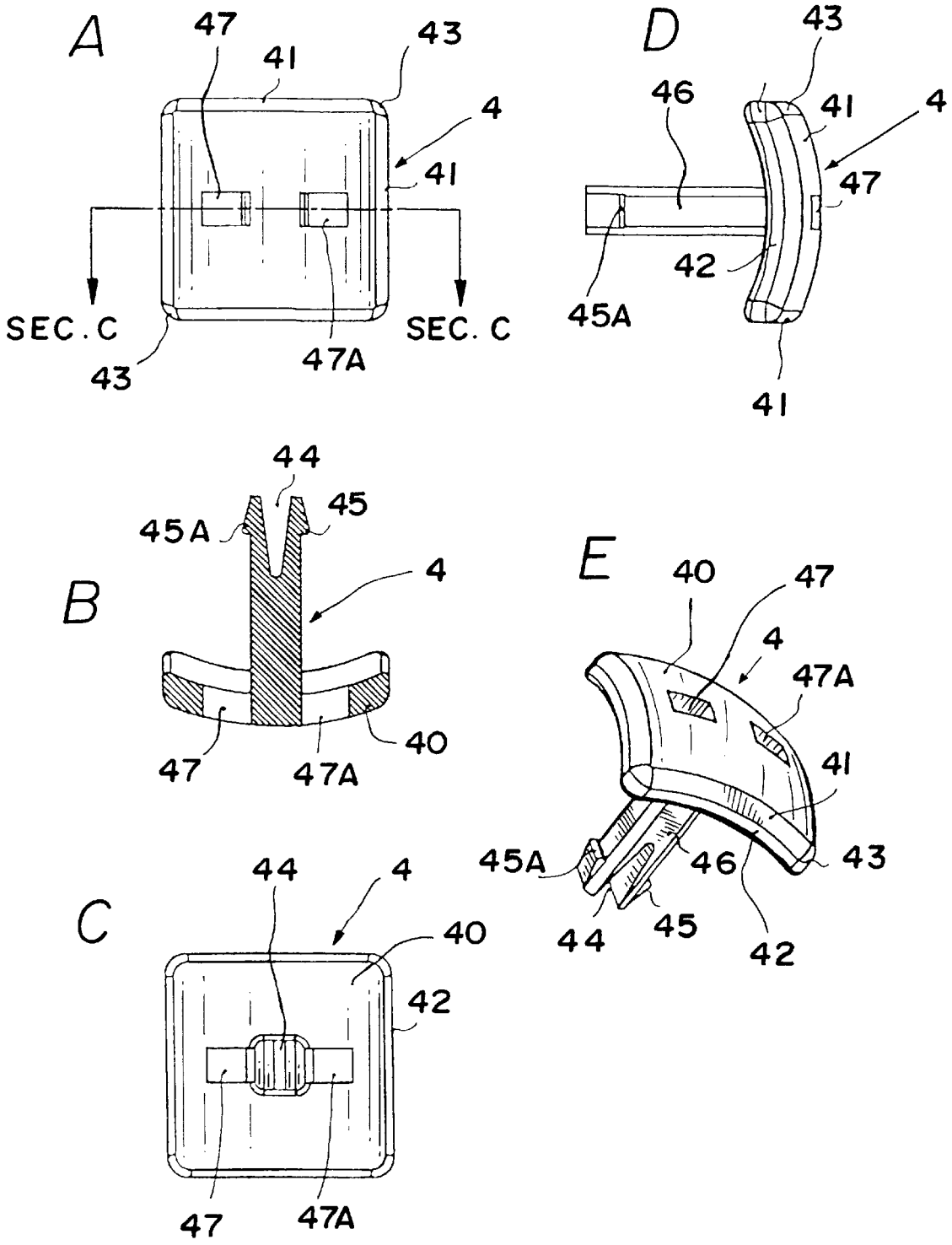

The hemisphere (10) has countersunk holes (18) (18A) diametrically opposed and projected obliquely for fitting the respective fittings (6–6A) which fasten into the corresponding female means (15–15A) (FIGS. 3B, 4B and 4D), situated inside the opposite hemisphere (11), and remain inside the said holes (18–18A) and underneath the surface of the hemisphere (10).

The said hemisphere (11) has, in its exterior surface (FIG. 4A), in a quadrant of the same, equivalent to an octant of the latter, more specifically in the place designed for coupling the pivot part (2), concave undercuts (17, 17A and 17D), which have an oblong profile and a straight end in the form of a truncated irregular ellipse.

These undercuts (17, 17A and 17B), as we see especially in FIGS. 2D and 2A–D, serve as coupling and seating for the retractile locking device composed of the spring (7) and ball (8).

These retractile locking devices, three in total, are almost entirely contained in the pivot part (2).

Figure 2A:
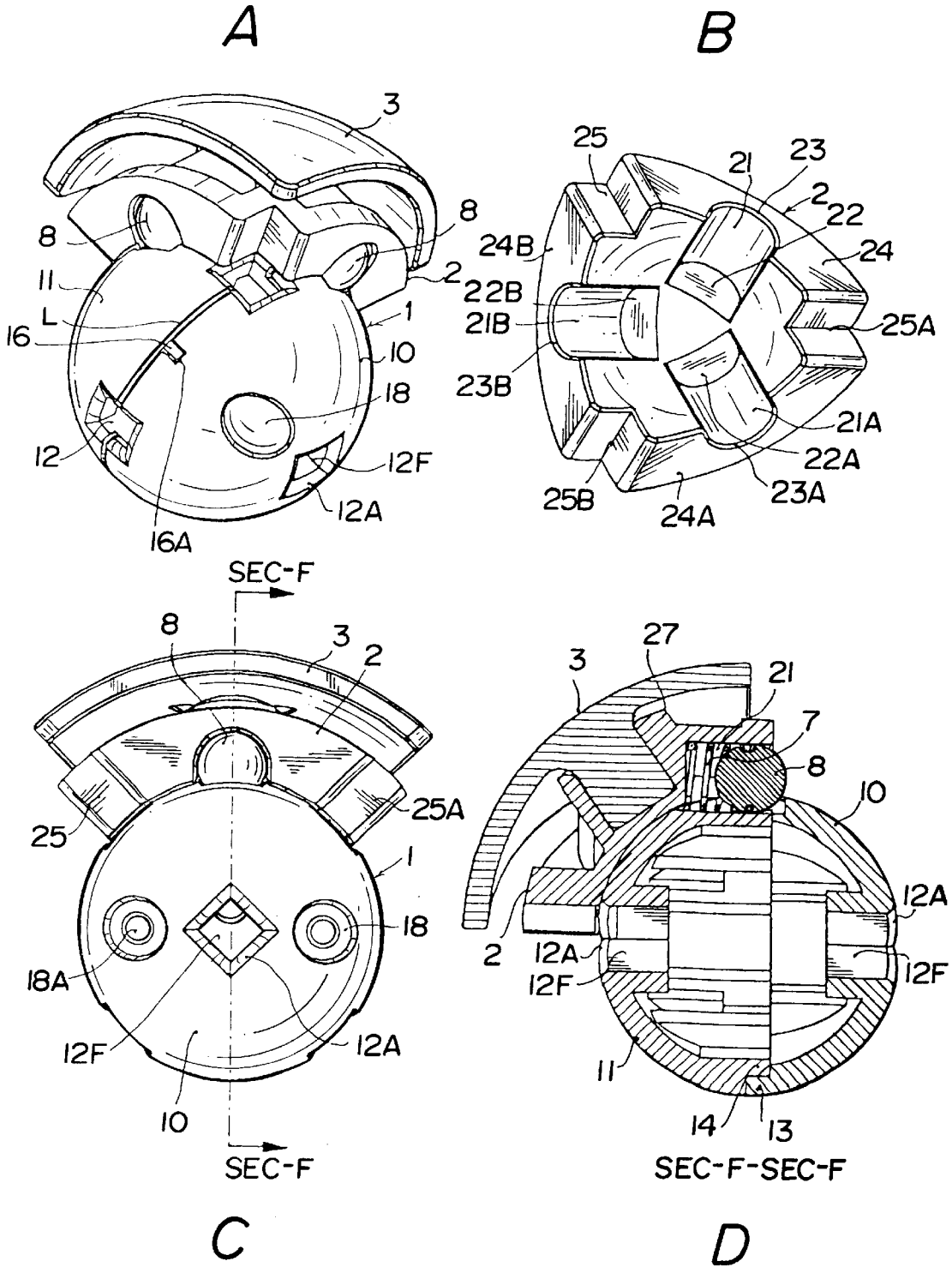

The said part (2) which, as we see in the different representations of FIGS. 2 and 2A, is a triangular-spherical part equivalent to a spherical octant, is equipped in its interior plane (20) with arched passages (21–21A and 21B) distributed according to the radial axes of the part. They are closed inside (22–22A and 22B) and open outside (23, 23A and 23B) constituting the housing for the locking devices, in accordance with FIGS. 2D and 2A–D, while the undercuts (17, 17A and 17B) serve as seating so that the truncated edges, (17C, 17D and 17E) respectively, act as a limit for the balls (8).

Figure 6:
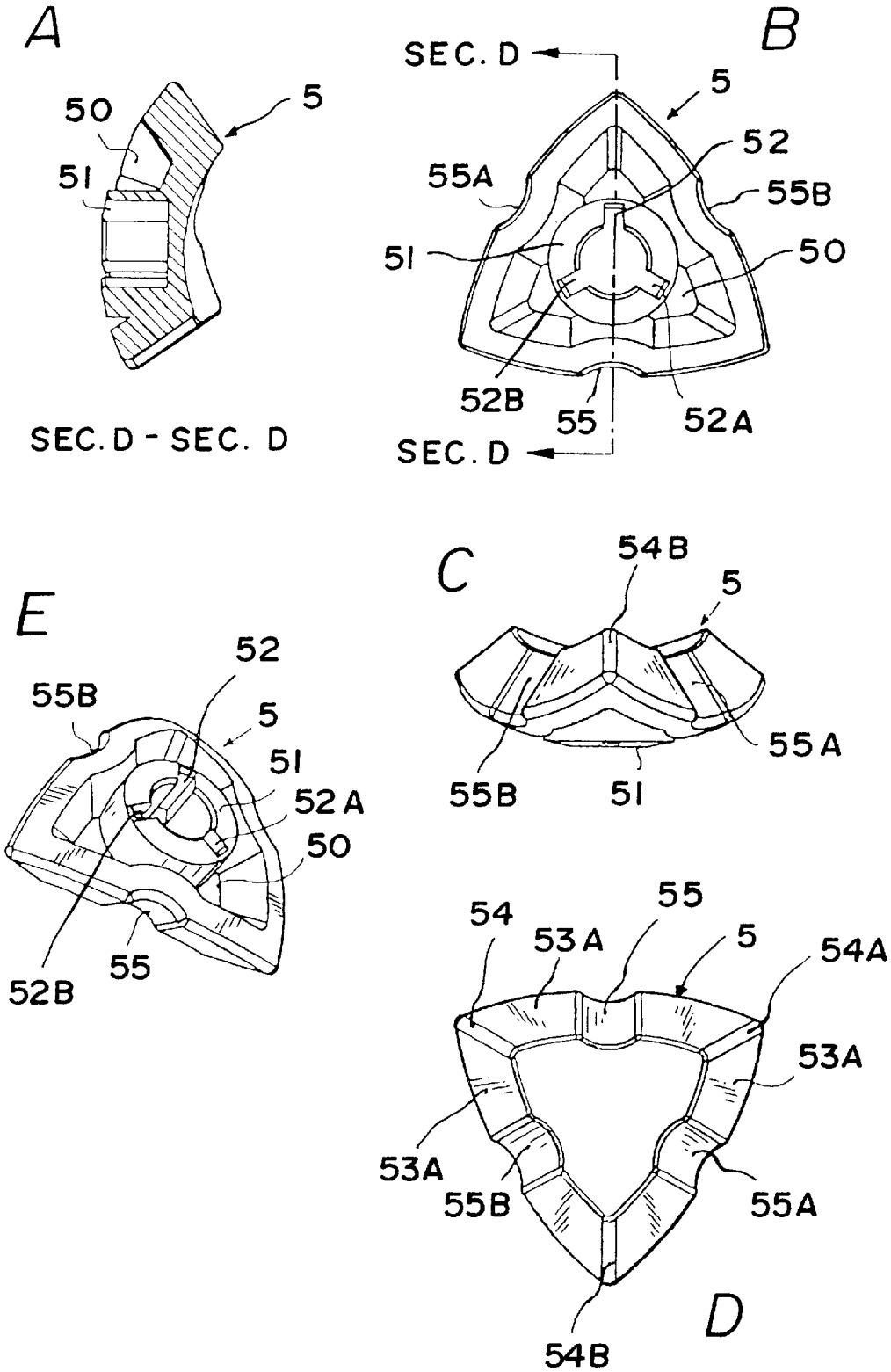

It may be appreciated from the said representation that the distance between the bottom (22–22A and 22B) and the openings (23–23A and 23B) of the arched passages (12, 21A and 21B) is less than the distance between the said bottoms and the limiting edges (17C, 17BD and 17E) of the undercuts (17, 17A and 17B), which allows the ball (8) to protrude slightly and partially from the part (2), forming three relative interlocking points for the movable parts (5) (FIG. 6).

As in the case known from the State of the Art, the sides (24–24A and 24B) of the part (2) are chamfered and slope downwards. The angle edges (25, 25A and 25D) are moulded at right angles so as to fit into the prismatic members of the adjacent guide parts (4).

Also, on its exterior plane, the said part (2) has a moulding (26) from which, centrally, the assembly device (27) projects for the respective covering or enveloping part (3) and is for this purpose provided with vertical slots (28, 28A and 28B) at 1200 for the bayonet fitting of the respective male assembly members of the part (3).

The six T-shaped parts that form the guide parts for the movable octants (5) and that immobilize the pivot part (2) are indicated in a general way (4).

They have a square-shaped head (40) and a curved spherical section with double-bevelled edges (41–42) and rounded angle edges (43).

The curved spherical section of the head (40) describes a lower curved plane that is equal to the spherical upper plane described by the movable parts (5) and/or the immobile parts (2) and an upper curved plane that is equal to the lower spherical plane described by the covering or enveloping parts (3). This allows the movable parts (5) and the respective piece (3) to move without undue rubbing, jamming or blocking.

The dimensions of the head (40) are designed so that, whatever the position of the part (5) in its movements and whatever the angle it lies in, it will always be, to a greater or lesser degree, guided by at least two heads (40) of the said guide parts (4), which makes accidental or even deliberate dislocation impossible, unless it is broken.

They are associated with a vertical prismatic pin (46) which is cut at its lower end by a V-shaped aperture (44) in the form of pincers and the two resulting tips have external projections (45–45A) in the form of harpoon hooks.

When the parts (4) are fitted on the spherical nucleus (1), the pins (46) fit into the square holes (12) slightly compressing the V-shaped aperture (44) until the hooks (45–45A) lock against the corners (12G), the walls (12B–12C) and/or the arms (12D–12E) and/or the square tube (12F) that delimit the interior housing of the cavities (12).

The pin (46) is directly related to openings (47–47A) in the head (40) situated laterally in relation to the said pins (46) simply to facilitate the moulding and demolding of the part that, as mentioned, is made of ABS.

It should be understood that while the V-shaped aperture (44) allows the pin (46) to fit tightly between the walls (12B–12C) or arm (12D–12E) or square tube (12F) of the housings (12), the pressure is not sufficiently strong to prevent the T-shaped part (4) having a certain relative vertical displacement in order to allow an extremely small, but sufficient, play, so that the octant's guide or the movable parts (5) are not forced or retained by the said guide part (4).

The said parts or movable octants indicated in general (5) (FIG. 6), which have, in accordance with what is known in the State of the Art, a general triangular-spherical shape, have in this case a moulding (50) on the upper plane from which a female assembly member (51) projects centrally. The latter is equipped inside and vertically with slots at 120° (52–52A and 52B) for bayonet fitting of the respective male assembly members (30) of the covering or enveloping parts (3).

These parts or movable octants (5) which are also of known form, defined by chamfered sides (53–53A–53B) sloping downwards and rounded angle edges 54–54A–54B), have in the center of said sides vertical trochilus mouldings (55–55A–55B), which are those provided for relative interlocking in the balls (8) which partially protrude from the pivot part (2), as described above and seen in figures (2D and 2A–D), in such a way that when the parts (5) are moved in the different movements necessary to carry out the game, in accordance with the invention, they rub in passing against the sides (24, 24A, 24D) of the part (2) and its smooth parts push the ball inwards (8) partially compressing the spring (7) until the said ball (8) coincides with one of the mouldings (55–55A–55B) of the part (5) and the spring (7) fires and the ball (8) fits into these mouldings (55–55A–55B). This slight locking is easily released by applying a slight pressure to the part (5).

Figure 8:
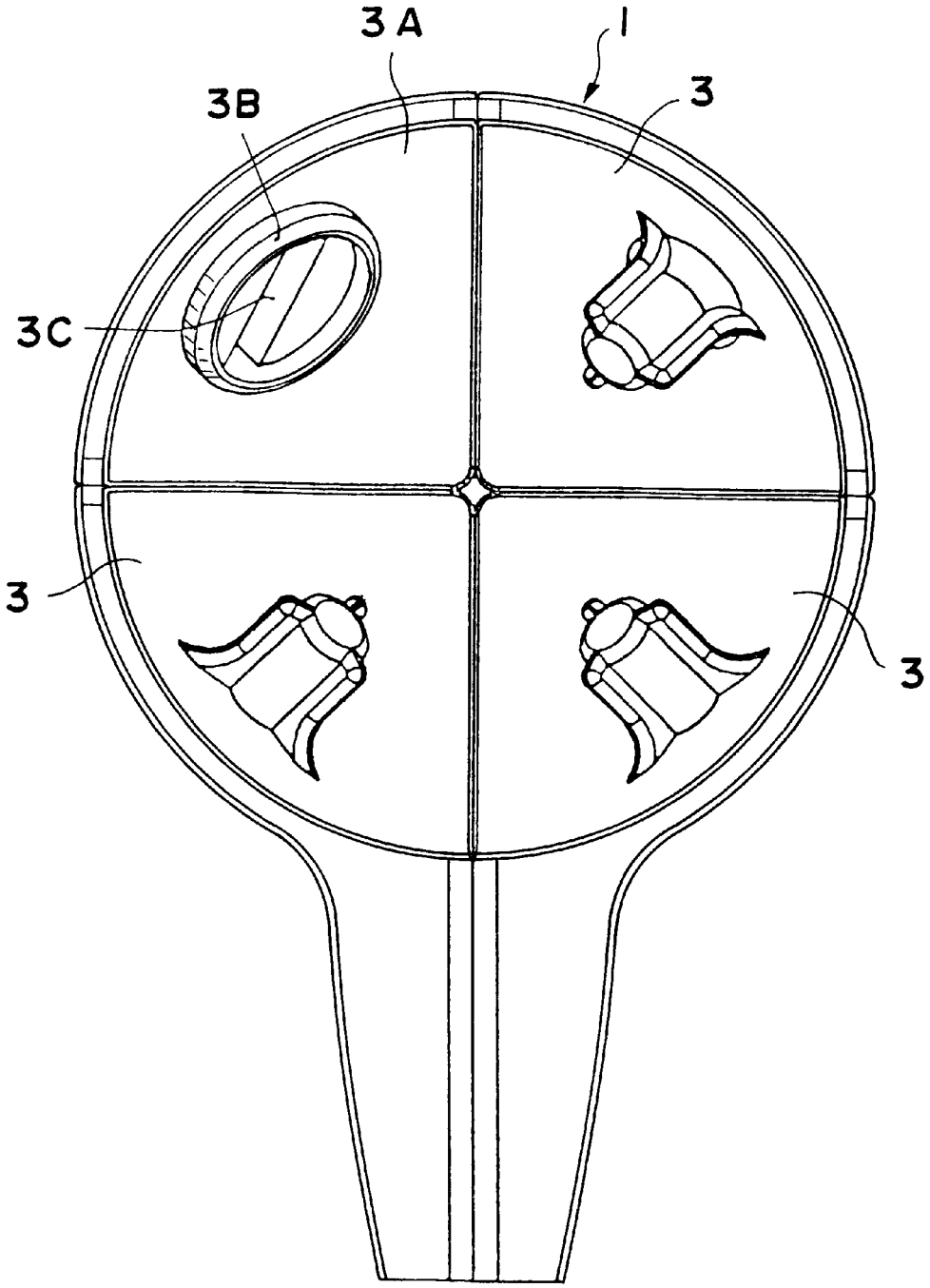

A part or external covering or enveloping octant (3), defining the figure of the toy, in a differently adapted version (3A), is represented in FIGS. 2A, C and D. It would be provided with a ring-shaped female member (3B) (FIG. 8) for adapting to the central assembly member (27) and a slot (3C) where the adaptor device of the pivot part (2A) penetrates, provided with a fork-shaped anchoring element (2B), the arms of which (2C–2D) are integral, and with the central assembly member (27) of the said part (2A). The anchoring device (2B) defines an aperture (2F) in the form of a hoop for fastening to an independent element or object, for example, a keyring (9) (FIGS. 9 and 9A).

Figure 9:
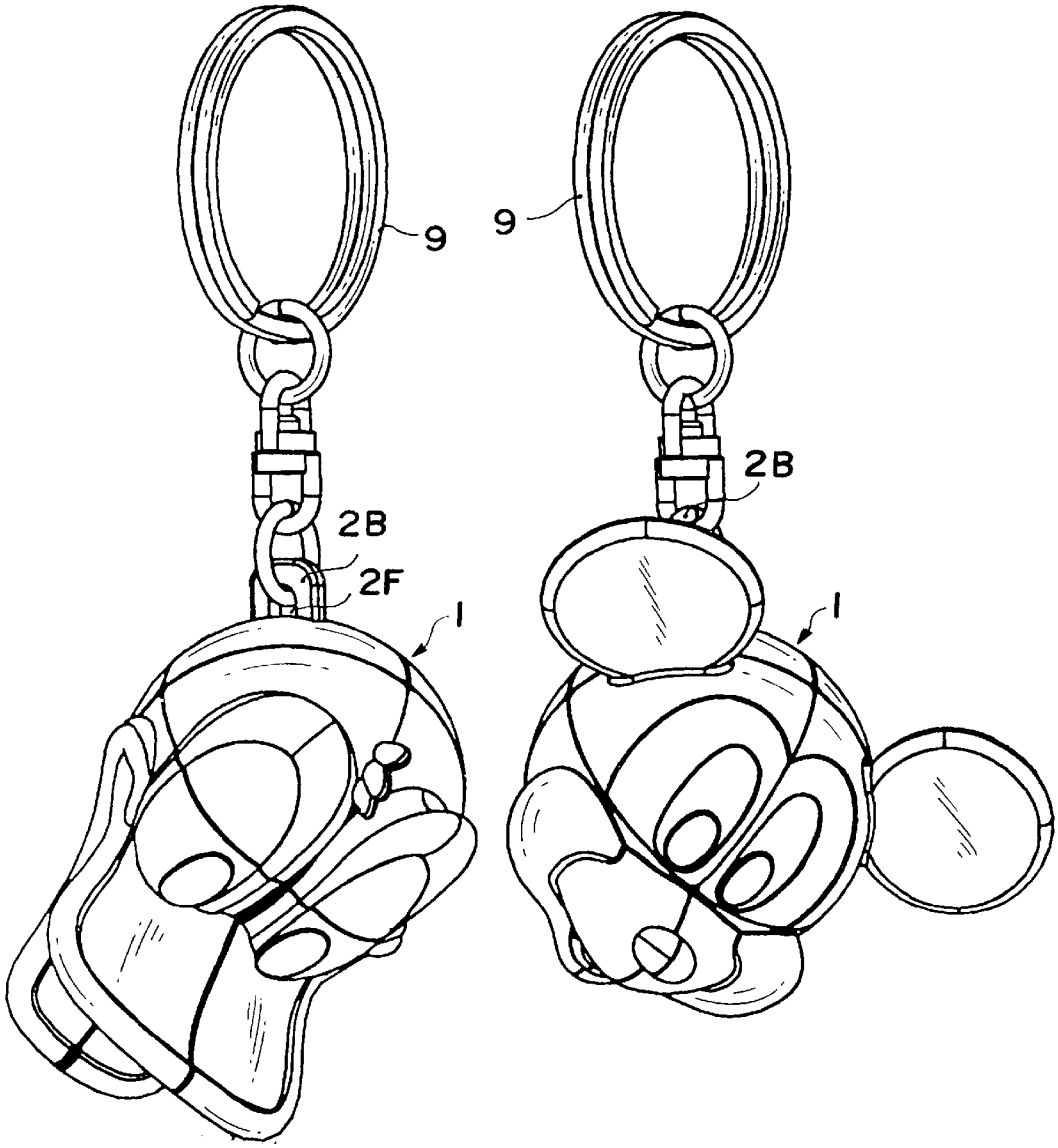
Figure 9A:
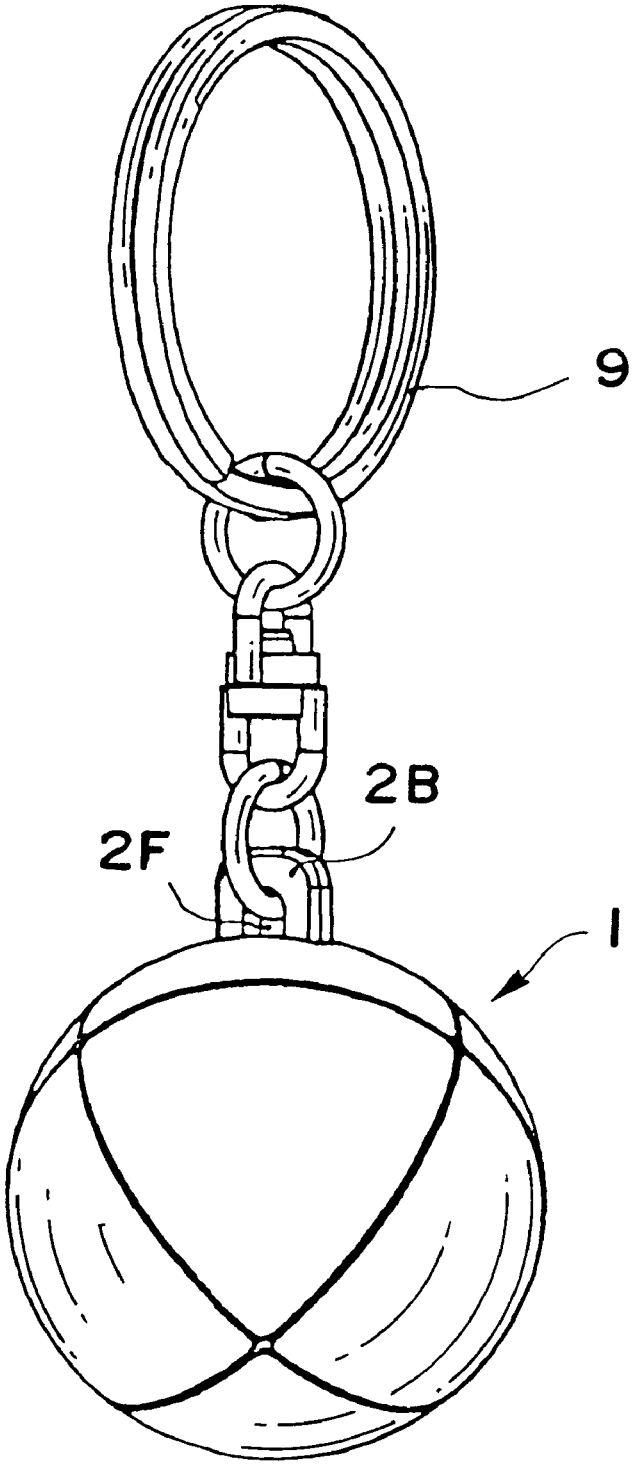
Figure 10:
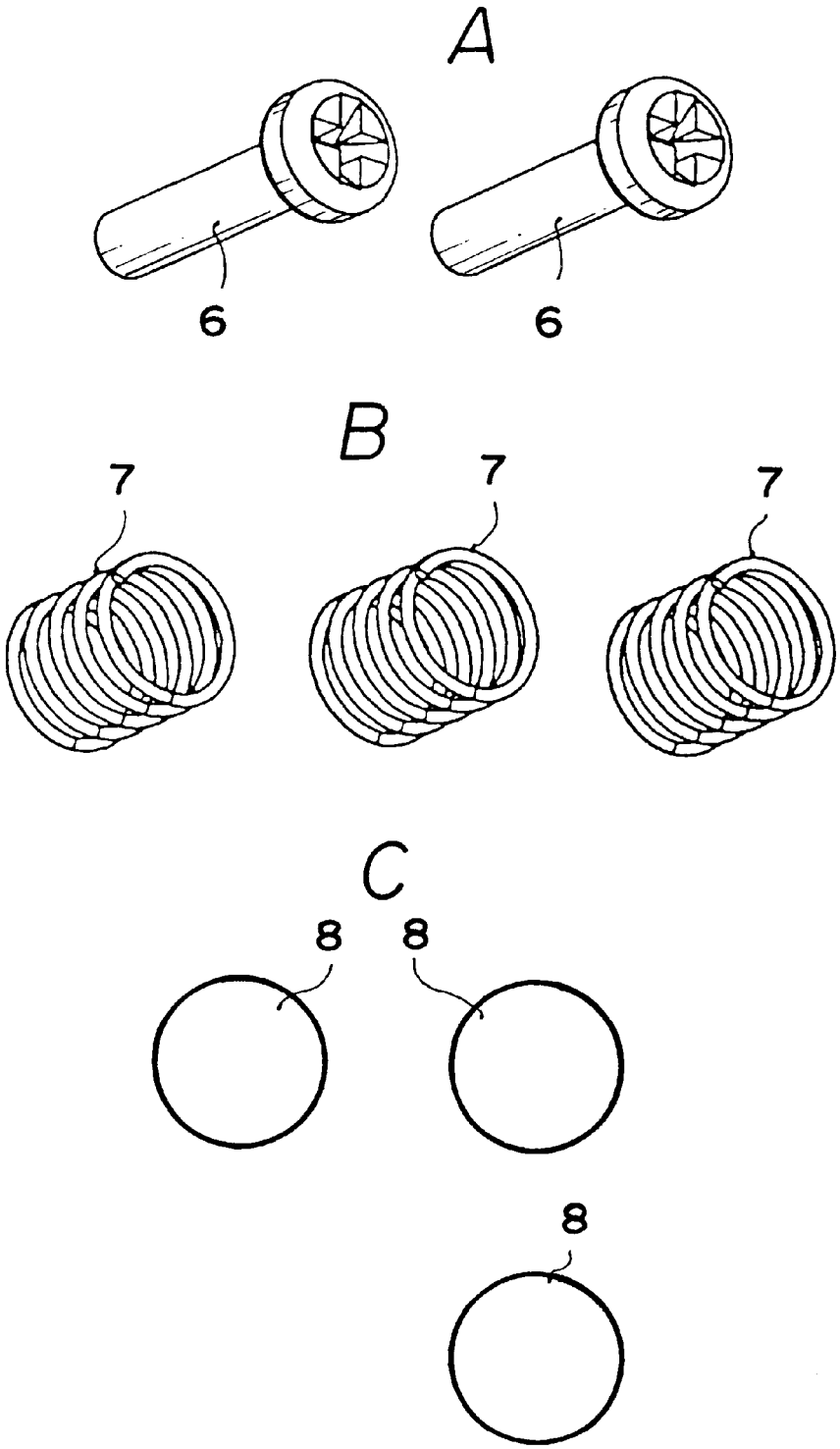

The versatility to be derived from the immobile pivot part (2–2A) represents a great advantage, as many different adaptations may be given to it so as to be able to couple it to many objects, without this placing any conditions on the development of the game, in accordance with the invention, in the many representations that may be adopted, of which a basic example is given in the said FIGS. 9 and 9A.

Once the nature of the model has been suitably described, it is stated for all purposes, that the model is not limited to the exact details of this description, but on the contrary, any modifications considered appropriate are to be introduced, provided that alterations are not made to the invention's essential characteristics, which are claimed hereinafter.

I claim:

1. DIDACTIC SKILL-DEVELOPING AND RECREATIONAL, MULTI-COMBINABLE MINIATURE TOY OR ORNAMENT, which comprises a spherical or hexahedral general body with any type of representation, made up substantially of a spherical nucleus (1) upon which eight parts are arranged each of which is a spherical octant, and seven of which are displaceable or movable (5) and one (2) fixed, sail movable octants being guided by means of six T-shaped parts (4), the octants (2–5) having assembly means (27–51) so as to hold and support other covering octants (3) which form the exterior body of the toy, wherein:

the spherical member (1) is made up of two hollow hemispheres (10–11) coupled together by means of tongue and groove assembly (13–14) and a bayonet joint centering element (16–16A); said hemispheres being joined by means of fittings (6–6A) and have six housings (12) for the T-shaped guide parts (4); holes (18, 18A) for access of the fittings (6–6A); three retractile locking devices; and internal female means (15–15A) for fixing and external coupling (17, 17A and 17B) to said three retractile locking devices;

six T-shaped guide parts (4) with means of fitting by pressure and fastening by means of anchoring;

an immobilized octant-pivot (2) which has inside three radial housings (21, 21A and 21B) for the respective retractile means of interlocking, which are moulded on their exterior surface with a central element;

seven movable octants (5) with lateral means—one on each side—for relative interlocking of the retractile locking devices of the immobilized pivot part;

an immobilized octant-pivot (2A) specially adapted to be fitted with independent objects, or instruments and;

eight covering octants, with assembly means to be fitted on the respective octant-pivots, which are movable, and with one being specially and differently adapted to be fitted in the aforementioned differently adapted pivot-part.

2. A toy or ornament having a generally spherical or hexahedral body showing any kind of representation thereon, said spherical or hexahedral body comprising a spherical nucleus (1), eight spherical octants arranged on said nucleus, six T-shaped guide parts (4) having pressure fitting means and anchoring means, and eight covering octants, said eight spherical octants having first assembly means (27–51) for holding and supporting said covering octants (3) and said covering octants having second assembly means for fitting on said eight spherical octants and forming said body of said toy or ornament, wherein:

said nucleus (1) comprises a first and a second hollow hemisphere (10–11) coupled together at an assembly line by means of a tongue and groove assembly (13–14) and a bayonet joint centering element (16–16A); said hemispheres being joined by means of fittings (6–6A), said fittings (6–6A) extending through holes (18, 18A) in the first hemisphere and fixed in internal female means (15–15A) of said second hemisphere; said spherical nucleus further comprising six housings (12) for said six T-shaped guide parts (4), three retractile locking devices, and external couplings (17, 17A and 17B) for said three retractile locking devices;

seven of said spherical octants are movable (5) and one of said spherical octants is fixed (2) as a pivot of rotation for said seven movable octants (5); said movable octants being guided by means of said T-shaped guide parts; and said one fixed octant (2) has three radial housings (21, 21A and 21B) for said retractile interlocking devices and assembly means, said retractile interlocking devices having an interior and an exterior surface, said exterior surface comprising a central element molded thereon, and said seven moveable octants (5) have lateral means—one on each side—for relative interlocking of said retractile locking devices of said fixed octant.

3. The toy or ornament claimed in claim 2, wherein said six housings (12) are distributed regularly and equidistantly in said nucleus (1); four of said housings are distributed at 90°, centered on said assembly line of said hemispheres (10–11); two of said housings are situated one at each pole of said hemispheres (10–11); said six housings further presenting square openings with beveled edges (12A) and a depth that is less than a radius of said nucleus (1), wherein:

said four housings centered on said assembly line of said hemispheres (10–11) are delimited by a pair of parallel internal walls (12B–12C) and a first arm (12D–12E) in said second hemisphere (11) and a second arm (12E) in said first hemisphere (10); said pair of walls and said first and second arms forming a square cage when said first and second hemispheres are fitted together; said square cage having inner edges (12G) forming anchoring limits for said T-shaped guide parts (4); and, said two housings situated at the poles of said first and second hemispheres (10–11) have the shape of a quadrangular tube (12F), said quadrangular tube (12F) having inner edges (12G) forming anchoring limits for said T-shaped guide parts (4).

4. The toy or ornament claimed in claim 2, wherein:

said T-shaped guide parts (4) comprise a vertical body and a square head (40);

said vertical body is a square prismatic pin (46) having a first and a second end, said first end being free and said second end being attached to said square head (40), said first end being cut by a V-shaped aperture (44) in the form of pincers with tips that have lateral projections (45–45A) in the form of harpoon hooks;

said square head (40) has a curved spherical section presenting an upper and a lower surface; the lower surface of said spherical section coinciding with an upper surface of said fixed and movable octants; the upper surface of said spherical section coinciding with a lower surface of said covering octants; and, said square head has double-beveled edges (41–42) and rounded angle edges (43).

5. The toy or ornament claimed in claim 2, wherein said holes (18, 18a) of said first hemisphere (10) are countersunk holes (18–18A) projected obliquely and aligned with said internal female means (15–15A) of said second hemisphere (11).

6. The toy or ornament claimed in claim 5, wherein said external couplings (17, 17A, and 17B) for said retractile locking devices are three oblong undercuts (17–17A–17B) having a concave bottom and a profile in the form of an irregular ellipse truncated in straight edges (17C–17D–17E); and wherein said retractile locking device comprises a ball (8), said undercuts forming a limit for said balls (8).

7. The toy or ornament claimed in claim 6, wherein said undercuts are distributed regularly and equidistantly in a space designated for said fixed octant (2).

8. The toy or ornament claimed in claim 6, wherein said fixed octant (2) has a triangular spherical form with chamfered sides (24, 24A, 24B) sloping downwards and angle edges molded at right angles (25, 25A, 25B) for immobilization; and further has an inner and an outer face; said inner face presenting arched passages or guides (21, 21A, 21B) having an open end (23, 23A, 23B) and a closed end (22, 22A, 22B), said open ends being directed towards said chamfered sides (24, 24A, 24B), wherein said arched passages or guides (21, 21A, 21B) are adapted for housing said retractile locking devices, and springs (7) and balls (8) symmetrically and radially arranged in said passages or guides (21 21A, 21B) for retaining said retractile locking devices.

9. The toy or ornament claimed in claim 8, wherein a distance between said closed end (22, 22A, 22B) and said open end (23, 23A, 23B) of said arched passages (21, 21A, 21B) is slightly shorter than a distance between said closed ends and said straight edges (17, 17D, 17E) of said undercuts (17, 17A, 17B), thereby allowing said ball (8) of said locking device to protrude partially and relatively from the respective side (24, 24A, 24B) of the fixed octant (2).

10. The toy or ornament claimed in claim 8, wherein said outer face of said fixed octant (2) comprises a moulding (26) from which emerges centrally a female assembly member (27) which slightly protrudes from said outer face of said fixed octant (2).

11. The toy or ornament claimed in claim 10, wherein said female assembly member (27) of said fixed octant (2A) is a fork-shaped part, having arms (2C–2B) and defining an aperture (2F) for fastening to any independent object or instrument.

12. The toy or ornament claimed in claim 11, wherein one of said covering octant (3A) comprises an interior ring-shaped adjusting element (3B) in a relief defined by said assembly member (27) of said fixed octant (2A) and a diametric slot (3C) for assembly of said covering octant (3A) in the fork-shaped part (2B) of said fixed octant (2A).

13. The toy or ornament claimed in claim 2, wherein said movable octants (5) have a triangular spherical form with three sides (53, 53A, 53B) and an inner and an outer face, each movable octant (5) comprising a moulded vertical recess (55, 55A, 55B) with beveled edges in a symmetrical center of each side (53, 53A, 53B), for relative interlocking of said retractile locking devices of the fixed octant (2) and said movable octant (5) having a moulding (50) in said outer face from which a female assembly member (51) emerges centrally, said female assembly member not protruding beyond said outer face of said movable octant (5).

14. The toy or ornament claimed in claim 2, wherein said external couplings (17, 17A, and 17B) for said retractile locking devices are three oblong undercuts (17–17A–17B) with a concave bottom and a profile in the form of an irregular ellipse truncated in straight edges (17C–17D–17E); and wherein said retractile locking device comprises a ball (8), said undercuts acting as a limit for said balls (8).

15. The toy or ornament claimed in claim 14, wherein said undercuts are distributed regularly and equidistantly in a space designated for said fixed octant (2).

16. The toy or ornament claimed in claim 2, wherein said fixed octant (2) has a triangular spherical form with chamfered sides (24, 24A, 24B) sloping downwards and angle edges molded at right angles (25, 25A, 25B) for immobilization; said fixed octant (2) having an inner and an outer face; said inner face presenting arched passages or guides (21, 21A, 21B) having an open end (23, 23A, 23B) and a closed end (22, 22A, 22B), said open ends being directed towards said chamfered sides (24, 24A, 24B), wherein said arched passages or guides (21, 21A, 21B) are adapted for housing said retractile locking devices, and springs (7) and balls (8) symmetrically and radially arranged in said passages or guides (21 21A, 21B) for retaining said retractile locking devices.

17. The toy or ornament claimed in claim 16, wherein a distance between said closed end (22, 22A, 22B) and said open end (23, 23A, 23B) of said arched passages (21, 21A, 21B) is slightly shorter than a distance between said closed ends and said straight edges (17, 17D, 17E) of said undercuts (17, 17A, 17B), thereby allowing said ball (8) of said locking device to protrude partially and relatively from the respective side (24, 24A, 24B) of the fixed ocant (2).

18. The toy orament claimed in claim 16, wherein said outer face of said fixed octant (2) comprises a moulding (26) from which emerges centrally a female assembly member (27) which slightly protrudes from said outer face of said fixed octant (2).

19. The toy or ornament claimed in claim 18, wherein said female assembly member (27) of said fixed octant (2A) is designed as a fork-shaped part, formed by arms (2C–2B) and defining an aperture (2F) for fastening to any independent object or instrument.

20. The toy or ornament claimed in claim 19, wherein one of said covering octants (3A) comprises an interior ring-shaped adjusting element (3B) in a relief defined by said assembly member (27) of said fixed octant (2A) and a diametric slot (3C) for assembly of said covering octant (3A) in the fork-shaped part (2B) of said fixed octant (2A).

21. The toy or ornament claimed in claim 2, wherein said one fixed spherical octant is specially adapted to be fitted with independent objects or instruments, and one of said covering octants is adapted to be fitted on said fixed octant specially adapted to be fitted with independent objects or instruments.

* * * * *